United States Patent [19]

Yamagishi et al.

[11] Patent Number: 4,925,502

[45] Date of Patent: May 15, 1990

[54] IRON-COBALT TYPE SOFT MAGNETIC MATERIAL

[75] Inventors: Wataru Yamagishi, Ebina; Tsutomu Iikawa, Kawasaki, both of Japan

[73] Assignee: Fujitsu Limited, Kawasaki, Japan

[21] Appl. No.: 241,246

[22] Filed: Sep. 7, 1988

[30] Foreign Application Priority Data

Dec. 28, 1987 [JP] Japan ..... 62-330133

[51] Int. Cl.[5] ..... H01F 1/04

[52] U.S. Cl. ..... 148/311; 148/313; 420/103; 420/435; 75/246

[58] Field of Search ..... 148/311, 313; 420/103, 420/435

[56] References Cited

U.S. PATENT DOCUMENTS 3,891,475 6/1975 Tomita et al. ..... 148/311

FOREIGN PATENT DOCUMENTS 0149281 7/1985 European Pat. Off. .
54-75410 6/1979 Japan .
55-59701 5/1980 Japan ..... 148/307
59-136457 8/1984 Japan ..... 148/311
60-89548 5/1985 Japan .
51-253348 11/1986 Japan .
61-291934 12/1986 Japan .
61-291934 12/1986 Japan .
62-54041 3/1987 Japan .

OTHER PUBLICATIONS

*IEEE Transactions on Magnetics* (the 24th INTERMAG, Apr. 15, 1986), W. Yamagishi et al.

Derwent Accession No. 87-154949, Questel Telesystems (WPIL), Derwent Publication Ltd., London-Abstract-and JP-A-62-093 342 (DAIDO).

Derwent Accession No. 86-336628, Questel Telesystems (WPIL), Derwent Publication Ltd., London-Abstract-and JP-A-61-253-348 (DAIDO).

*Primary Examiner*—John P. Sheehan

*Attorney, Agent, or Firm*—Staas & Halsey

[57] ABSTRACT

The iron-cobalt type soft magnetic material contains 35% to 60% by weight of cobalt, 0.03% to 2.0% by weight of aluminum, the remainder being iron, and is prepared by powder metallurgy.

3 Claims, 5 Drawing Sheets

IRON-COBALT TYPE SOFT MAGNETIC MATERIAL

BACKGROUND OF THE INVENTION

1. Field of the Invention

The present invention relates to an iron-cobalt soft magnetic material. More specifically, it relates to an iron-cobalt type soft magnetic material obtained by an addition of aluminum to an iron-cobalt alloy, and having a plastic deformability which can not be obtained by an alloy prepared by the conventional melt casting method.

2. Description of the Related Art

Iron-cobalt type soft magnetic materials have been practically applied only in limited fields, such as vibrating plates for receivers and magnetic poles for high performance electromagnets.

In the prior art, as soft magnetic materials for industrial uses, iron, silicon steel, Permalloy (alloy of Ni 40–90% and remainder Fe), Sendust (iron alloy containing Al 5%, Si 9% and remainder Fe), and Permendur (alloy of Co 50% and remainder Fe), are known.

Among the above, that having the highest saturation magnetization is Permendur, but this alloy has a drawback in that it is very brittle and is difficult to work under cold conditions. Accordingly, 2V-Permendur has been proposed as a product having an improved cold workability due to an addition of about 2% of vanadium thereto, but the workability thereof is not completely satisfactory.

Accordingly, the present inventors previously filed a patent application for an iron-50% cobalt sintered alloy and a method for preparing the same by powder metallurgy (see Japanese Unexamined Patent Publication (Kokai) No. 61-291934) to enable many of the working steps in the preparation process of a soft magnetic material to be omitted. But, even when prepared by powder metallurgy, a problem arises in that a required plastic deformability, depending on the application, cannot be obtained.

SUMMARY OF THE INVENTION

Accordingly, the objects of the present invention are to eliminate the above-mentioned problems of the prior art and to provide a novel iron-cobalt type soft magnetic material having a plastic deformability which is not obtainable in an alloy prepared by the conventional melt casting method.

Other objects and advantages of the present invention will be apparent from the following description.

In accordance with the present invention, there is provided an iron-cobalt type soft magnetic material consisting essentially of 35% to 60% by weight of cobalt and 0.03% to 2.0% by weight of aluminum, the remainder being iron, and prepared by powder metallurgy.

The iron-cobalt type soft magnetic material according to the present invention has a plastic deformability, and therefore, the preparation and workability thereof are good. Accordingly, the degree of freedom of shape thereof is increased, and thus a practical application in, for example, terminal instruments peripheral to computers, where more complicated shapes are required, can be obtained.

BRIEF DESCRIPTION OF THE DRAWINGS

The present invention will be better understood from the description set forth below with reference to the drawings, in which.

DESCRIPTION OF THE PREFERRED EMBODIMENTS

Figure 1:
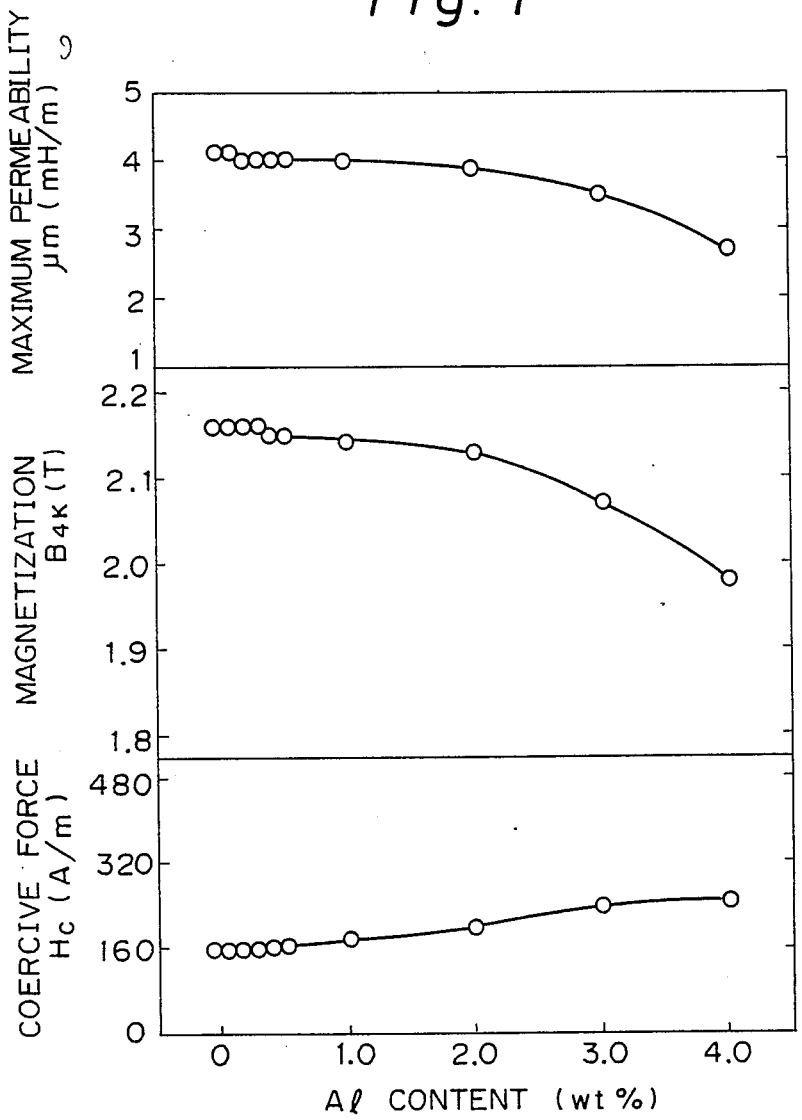
FIG. 1 is a graph showing the relationships between the Al content and maximum magnetic permeability ($\mu m$), magnetization ($B_{4k}$), and coercive force (Hc) in a magnetic field of 4 kA/m, when 0 to 4.0% by weight of Al is added to the iron-cobalt alloy having a content of Fe/Co=1 (weight ratio) (i.e., Fe-50% Co) in Example 1 and prepared by powder metallurgy.

According to the present invention, as mentioned above, an iron-cobalt type soft magnetic material having a plastic deformability can be obtained by powder metallurgy, by adding 0.03% to 2.0% by weight of aluminum to the iron-cobalt alloy.

More specifically, according to the present invention, by suitably combining iron powder, cobalt powder, and pre-alloyed iron-cobalt powder, and further, using, in addition thereto as the aluminum component, pre-alloyed iron-aluminum powder or aluminum powder, an iron-cobalt soft magnetic material with a composition ratio of 35% to 60% by weight of cobalt and 0.03% to 2.0% by weight of aluminum can be prepared by powder metallurgy.

If the cobalt content in the soft magnetic material according to the present invention is outside the range of 35% to 60% by weight, a high magnetic permeability cannot be obtained, and thus preferably the cobalt content is 45% to 55% by weight.

The aluminum content in the soft magnetic material according to the present invention is restricted to 0.03% to 2.0% by weight. If the aluminum content exceeds 2% by weight, the saturation magnetization and the maximum permeability are unacceptably decreased and the hardness and the coercive force are increased. Conversely, if the aluminum content is less than 0.03% by weight, the hardness or brittleness is not decreased and an improved plastic deformability cannot be obtained as desired for the purpose of the present invention. Accordingly, the aluminum content is preferably 0.1% to 1.0% by weight, more preferably 0.1% to 0.5% by weight.

According to the present invention, the metal powdery mixture having the composition as mentioned above is subjected to powder metallurgy. Powder metallurgy is known as a method of preparing materials by compacting and sintering metal powder, but as known in the art, it is difficult to obtain a high density sintered alloy with a mixture of pure Fe powder and pure Co powder because Kirkendall voids are formed during sintering, due to the difference in the diffusion coefficients of Fe and Co. Nevertheless, this problem probably caused by a greater diffusion coefficient of iron to cobalt than the diffusion coefficient of cobalt to iron can be preferably solved according to the present invention when pre-alloyed Fe-rich Fe-Co powder and Co powder are used as the starting material.

According to the present invention, the hardness or brittleness is also reduced by an addition of aluminum to the iron-cobalt alloy, as described above, to obtain an iron-cobalt alloy having a plastic deformability, and having magnetic property values which are satisfactory in practical application.

EXAMPLES

The present invention will now be further illustrated by, but is by no means limited to, the following Examples and Comparative Examples, in which all "parts" and "%" are by weight.

EXAMPLE 1

As the starting material powders, 55 to 62.5 parts of pre-alloyed Fe-20% Co powder (325 mesh or less), 37 to 37.5 parts of Co powder (400 mesh or less), and 0 to 8 parts of pre-alloyed Fe-50% Al powder (325 mesh or less) were used to prepare Fe/Co=1 and 0 to 5.0% of Al, and further 0.75% of zinc stearate was added and mixed as a lubricant. These mixed powders were compacted into a shape 45 mmΦ×35 mmΦ×7 mm t under a compacting pressure of 4 t/cm$^2$, the lubricant was removed from the compacted powder at 400° C. under a hydrogen atmosphere for 1 hour, and then pre-sintering was effected at 600° to 750° C., in accordance with the Al content under a hydrogen atmosphere for 1 hour, followed by recompacting under a pressure of 6 t/cm$^2$. Then, sintering was effected at 1400° C. under a hydrogen atmosphere for 1 hour.

Figure 2:
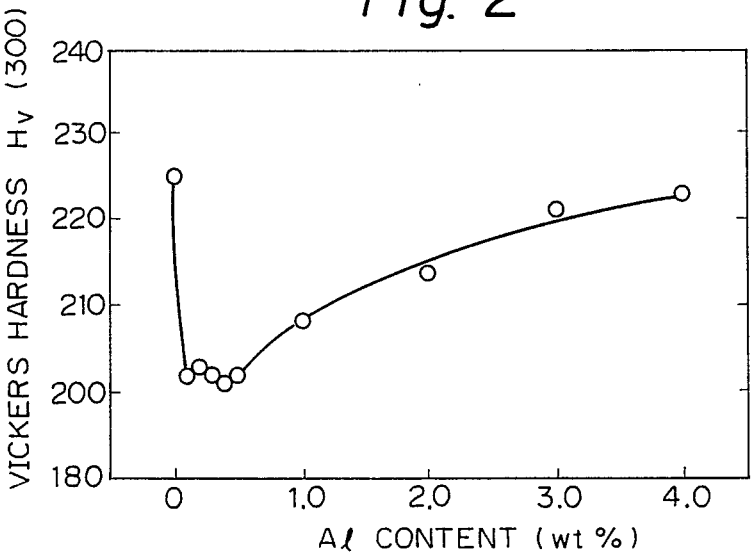
FIG. 2 is a graph showing the relationship between the Al content and the Vickers hardness.
Figure 3:
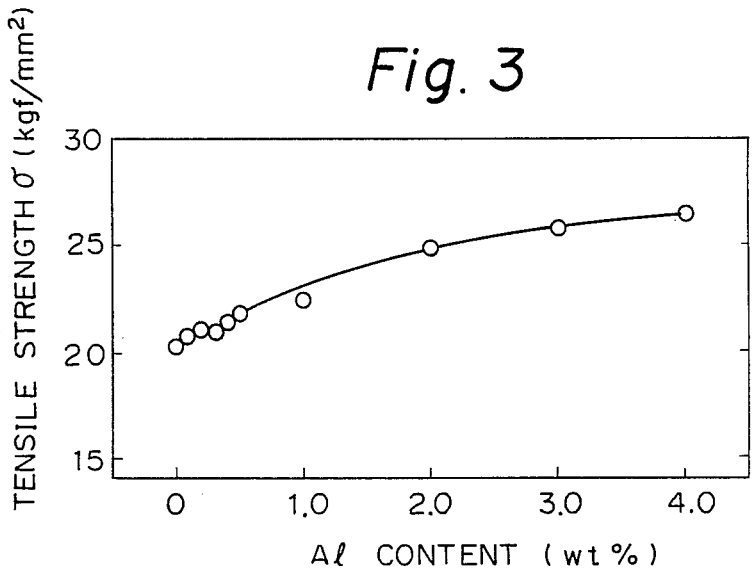
FIG. 3 is a graph showing the relationship between the Al content and the tensile strength.

The magnetic properties, Vickers hardness, and tensile strength of the samples obtained were measured, and the results are shown in Table 1, and FIG. 1 to FIG. 3, respectively.

TABLE 1

| Al Content (wt %) | Magnetic Properties: Coercive Force Hc (A/m) | Magnetization $B_{4k}$ (T) | Maximum Permeability μm (mH/m) | Mechanical Properties: Vickers Hardness Hv (300) | Tensile Strength (kgf/mm$^2$) |
|---|---|---|---|---|---|
| 0 | 160 | 2.16 | 4.1 | 225 | 20.3 |
| 0.1 | 160 | 2.16 | 4.1 | 202 | 20.8 |
| 0.2 | 160 | 2.16 | 4.0 | 203 | 21.0 |
| 0.3 | 160 | 2.16 | 4.0 | 202 | 21.0 |
| 0.4 | 165 | 2.15 | 4.0 | 201 | 21.4 |
| 0.5 | 168 | 2.15 | 4.0 | 202 | 21.8 |
| 1.0 | 180 | 2.14 | 3.9 | 208 | 22.4 |
| 2.0 | 200 | 2.13 | 3.8 | 214 | 24.8 |
| 3.0 | 240 | 2.07 | 3.5 | 221 | 25.6 |
| 4.0 | 248 | 1.98 | 2.7 | 223 | 26.4 |
| 5.0 | 276 | 1.88 | 2.0 | 228 | 27.0 |

EVALUATION METHODS

1. Magnetic properties: using a ring test strip Φ45×Φ35×7 t mm, the magnetization ($B_{4k}$), coercive force (Hc), and maximum permeability (μm) were measured by a direct current magnetic hysteresis loop tracer under the application of a maximum magnetic field of 4 kA/m (50 Oe).

2. Mechanical properties:

(1) Hardness test: the Vickers hardness under a load of 300 g was measured by a Leitz micro-hardness meter.

(2) Tensile test: a test strip according to JIS Z2550 was prepared, and the tensile strength thereof was measured at a tensile speed of 1 mm/min. by an Instron type universal testing machine.

EXAMPLE 2

As the starting material, pre-alloyed Fe-20% Co powder (325 mesh or less), and Co powder (400 mesh or less), were used to prepare various Fe-Co soft magnetic materials having various cobalt contents, by powder metallurgy in the same manner as in Example 1.

The magnetic properties and the mechanical properties of the resultant materials evaluated in the same manner as in Example 1 are shown in Table 2.

TABLE 2

| Co Content (wt %) | Magnetic Properties: Coercive Force Hc (A/m) | Magnetization $B_{4k}$ (T) | Maximum Permeability μm (mH/m) | Mechanical Properties: Vickers Hardness Hv (300) | Tensile Strength (kgf/mm$^2$) |
|---|---|---|---|---|---|
| 35 | 240 | 1.65 | 1.4 | 162 | 25.5 |
| 40 | 224 | 1.70 | 2.4 | 200 | 23.5 |
| 45 | 200 | 1.92 | 3.0 | 215 | 21.5 |
| 50 | 160 | 2.16 | 4.1 | 225 | 20.3 |
| 55 | 320 | 2.00 | 2.0 | 220 | 25.5 |

*1Fe Content is (100 - Co content) %

EXAMPLE 3

As the starting material, pre-alloyed Fe-20% Co powder (325 mesh or smaller), Co powder (400 mesh or smaller), and pre-alloyed Fe-50% Al powder (325 mesh or smaller) were used to prepare various Fe-Co-Al soft magnetic materials having various aluminum contents, by powder metallurgy in the same manner as in Example 1.

The magnetic properties and the mechanical properties of the resultant materials evaluated in the same manner as in Example 1 are shown in Tables 3, 4, and 5.

TABLE 3

| Al Content (wt %) | Magnetic Properties: Coercive Force Hc (A/m) | Magnetization $B_{4k}$ (T) | Maximum Permeability μm (mH/m) | Mechanical Properties: Vickers Hardness Hv (300) | Tensile Strength (kgf/mm$^2$) |
|---|---|---|---|---|---|
| 0 | 160 | 2.16 | 4.1 | 225 | 20.3 |
| 0.03 | 160 | 2.16 | 4.1 | 220 | 20.5 |
| 0.05 | 160 | 2.16 | 4.1 | 209 | 20.5 |
| 0.08 | 160 | 2.16 | 4.1 | 204 | 20.8 |

*1Fe Content (%) = 50 − ½ Al Content
Co Content (%) = 50 - ½ Al Content

TABLE 4

| Al Content (wt %) | Magnetic Properties: Coercive Force Hc (A/m) | Magnetization $B_{4k}$ (T) | Maximum Permeability μm (mH/m) | Mechanical Properties: Vickers Hardness Hv (300) | Tensile Strength (kgf/mm$^2$) |
|---|---|---|---|---|---|
| 0 | 200 | 1.92 | 3.2 | 215 | 20.0 |
| 0.05 | 200 | 1.92 | 3.2 | 212 | 20.6 |
| 0.1 | 200 | 1.90 | 3.2 | 200 | 20.6 |
| 0.3 | 208 | 1.90 | 2.9 | 196 | 20.8 |

TABLE 4-continued

| Al Content (wt %) | Magnetic Properties: Coercive Force Hc (A/m) | Magnetization $B_{4k}$ (T) | Maximum Permeability μm (mH/m) | Mechanical Properties: Vickers Hardness Hv (300) | Tensile Strength (kgf/mm²) |
|---|---|---|---|---|---|
| 0.5 | 224 | 1.88 | 2.8 | 195 | 20.8 |
| 1.0 | 246 | 1.86 | 2.5 | 202 | 21.4 |
| 2.0 | 260 | 1.86 | 2.3 | 210 | 22.5 |

*[1]Fe Content (%) = 55 − ½ Al Content
Co Content (%) = 45 - ½ Al Content

TABLE 5

| Al Content (wt %) | Magnetic Properties: Coercive Force Hc (A/m) | magnetization $B_{4k}$ (T) | Maximum Permeability μm (mH/m) | Mechanical Properties: Vickers Hardness Hv (300) | Tensile Strength (kgf/mm²) |
|---|---|---|---|---|---|
| 0 | 320 | 2.00 | 2.0 | 220 | 25.5 |
| 0.05 | 320 | 2.00 | 2.0 | 218 | 25.5 |
| 0.1 | 320 | 2.00 | 2.0 | 202 | 25.6 |
| 0.3 | 350 | 2.00 | 1.8 | 194 | 25.8 |
| 0.5 | 360 | 1.98 | 1.6 | 192 | 25.8 |
| 1.0 | 380 | 1.96 | 1.5 | 200 | 26.5 |
| 2.0 | 400 | 1.90 | 1.3 | 214 | 27.4 |

*[1]Fe Content (%) = 45 − ½ Al Content
Co Content (%) = 55 - ½ Al Content

EXAMPLE 4

As the starting material, pre-alloyed Fe-20% Co powder (325 mesh or smaller), Co powder (400 mesh or smaller), and pre-alloyed Fe-50% Al powder (325 mesh or smaller) or pre-alloyed Fe-52.3% V powder (325 mesh or smaller) were used to prepare various (50½χ)% Fe-(50½χ)% Co-χ% Al or V magnetic materials having various Al or V contents, by powder metallurgy in the same manner as in Example 1.

Figure 4:
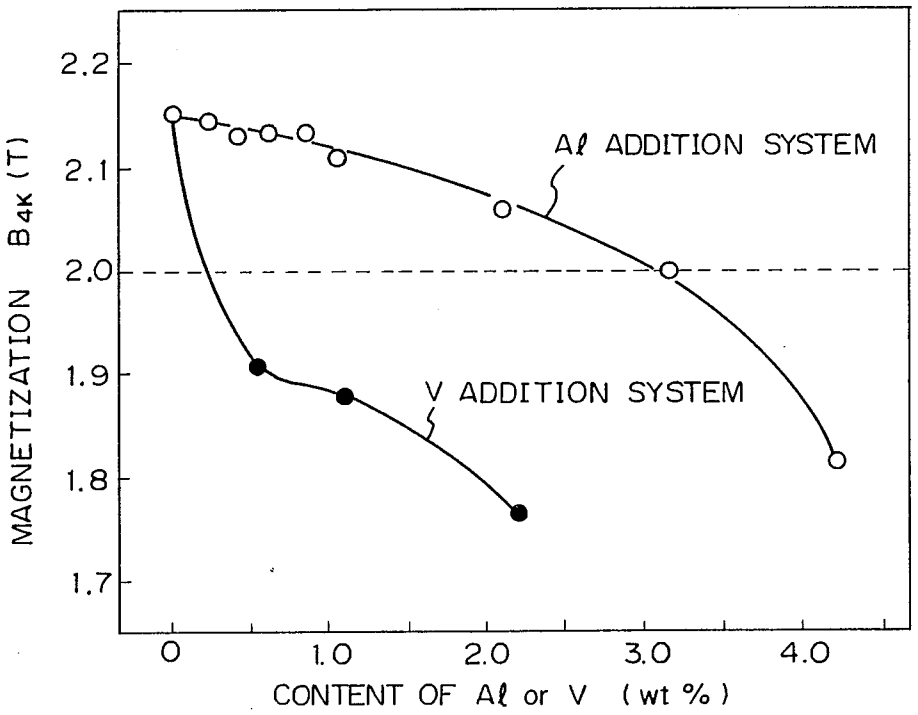
FIG. 4 is a graph showing the relationship between the magnetization ($B_{4k}$) and the content ($\chi$) of aluminum or vanadium contained in $(50\frac{1}{2}\chi)$%Fe-$(50\frac{1}{2}\chi)$%Co-$\chi$% Al or V materials in Example 4.

The relationships between the magnetization ($B_{4k}$) and the amounts of Al or V added are shown in FIG. 4.

Example 5

Figure 5:
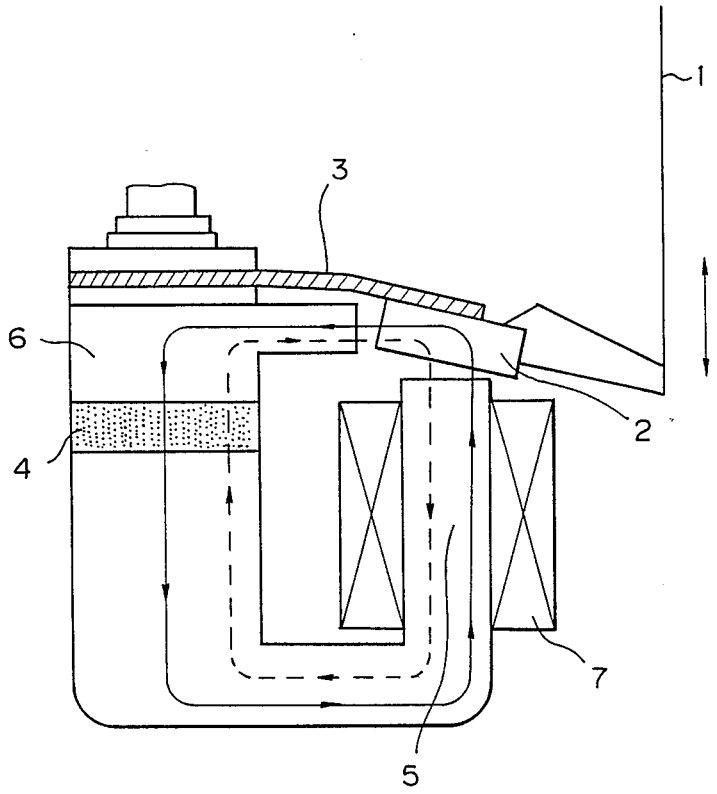
FIG. 5 is a schematical drawing illustrating a print head for the wire-dot matrix printers used in Example 5; and, FIG. 6 is a graph showing the relationship between a printing force and a stroke of a print head in Example 5.

The sintered alloy according to the present invention was applied in the magnetic circuit yoke for a print head in a 24-wire-dot matrix printer. The print head for the wire-dot matrix printers is shown in FIG. 5. A print wire 1 was fixed to an armature 2 and a spring system 3 was normally retracted by a magnetic field circulated through a permanent magnet 4, a core 5, and a yoke 6. This magnetic field held the wire back. When an opposing magnetic field was induced by a coil 7, the energy stored in the retracted spring 3 caused the wire to shoot forward. Accordingly, if a higher magnetic field is possible, a stronger spring can be used, and this will result in a higher printing speed.

Figure 6:
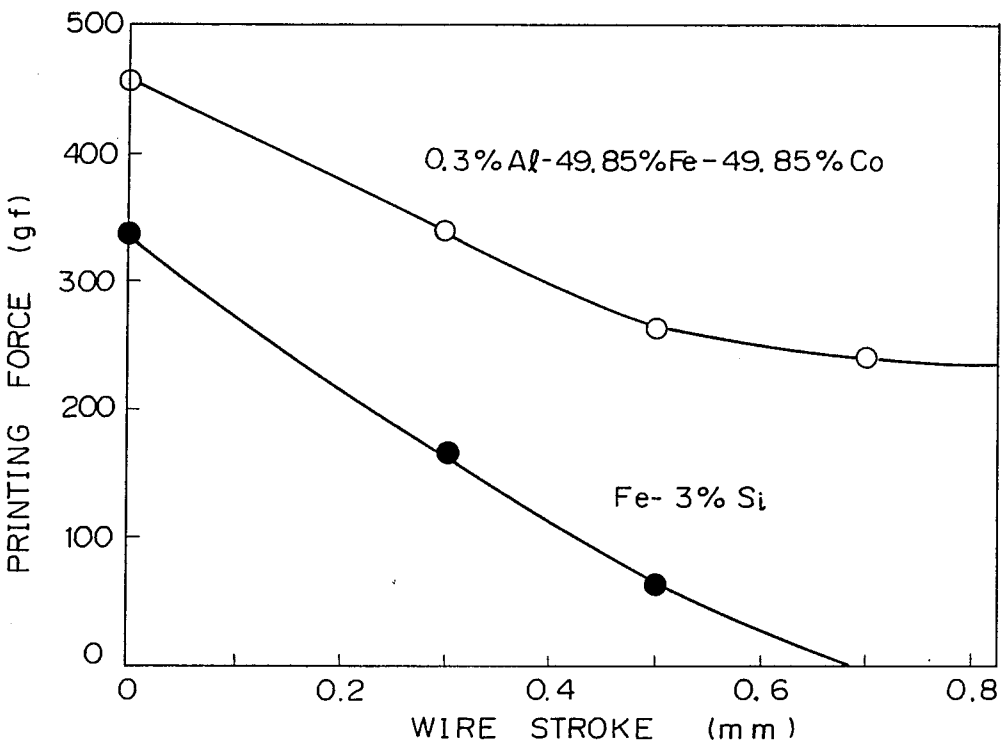

FIG. 6 shows correlations between a printing force versus wire stroke of the print head using the 0.3% Al-49.85% Fe-49.85% Co sintered alloy, compared to that of the Fe-3% Si sintered alloy. Fe-3% Si alloy is normally used for a magnetic circuit yoke and cores. The Fe-3% Si sintered alloy used in this study had a $B_{4k}$of 1.6 T, Hc of 35 A/m, and μm of 22.5 mH/m. For each wire stroke, the printing force of the print head using the 0.3% Al-49.85% Fe-49.85% Co sintered alloy was larger than that of the print head using the Fe-3% Si sintered alloy. This is due to the higher magnetization of the 0.3% Al-49.85% Fe-49.85% Co sintered alloy.

As a result, the printer was able to print at a printing speed of 110 cps for chinese character printing and 330 cps for alphanumeric printing, the highest printing speed known for a 24-wire-dot matrix printer.

We claim:

1. An iron-cobalt soft magnetic material consisting essentially of 35% to 60% by weight of cobalt, 0.03% to 2.0% by weight of aluminum, the remainder being iron, said iron-cobalt soft magnetic material being prepared by compacting and sintering a mixture comprising cobalt powder, iron-rich iron-cobalt powder, and aluminum or iron-aluminum powder.

2. An iron-cobalt soft magnetic material as claimed in claim 1, wherein the cobalt content is 45% to 55% by weight.

3. An iron-cobalt soft magnetic material as claimed in claim 1, wherein the aluminum content is 0.1% to 1.0% by weight.

* * * * *

UNITED STATES PATENT AND TRADEMARK OFFICE

CERTIFICATE OF CORRECTION

PATENT NO. : 4,925,502

DATED : May 15, 1990

INVENTOR(S) : WATARU YAMAGISHI

It is certified that error appears in the above-identified patent and that said Letters Patent is hereby corrected as shown below:

Front Page, [56] References Cited - FOREIGN PATENT DOCUMENTS

"51-253348" should be --61-253348--;

delete the second occurrence of "61-291934"

Column 5, line 40, "(50 1/2X)%" should be --(50-1/2X)%--;

line 41, "(50 1/2X)%" should be --(50-1/2X)%--.

Signed and Sealed this

Sixth Day of August, 1991

*Attest:*

*Attesting Officer*

HARRY F. MANBECK, JR.

*Commissioner of Patents and Trademarks*